US005992052A

United States Patent [19]

Moretti

[11] Patent Number: 5,992,052

[45] Date of Patent: Nov. 30, 1999

[54] VAPOR PERMEABLE SHOE WITH IMPROVED TRANSPIRATION ACTION

[75] Inventor: Mario Polegato Moretti, Crocetta Del Montello, Italy

[73] Assignee: Nottington Holding B.V., Amsterdam, Netherlands

[21] Appl. No.: 09/175,965

[22] Filed: Oct. 21, 1998

[30] Foreign Application Priority Data

Oct. 21, 1997 [IT] Italy ..... PD97A0230

[51] Int. Cl.[6] ..... A43B 7/06; A43B 7/08; A43B 1/14; A43B 13/28

[52] U.S. Cl. ..... 36/3 B; 36/59 C; 36/4; 36/14; 36/103; 36/84; 36/29

[58] Field of Search ..... 36/29, 28, 32 R, 36/3 B, 84, 98, 102, 103, 14, 45, 55, 4, 59 C, 11.5, 11.6, 8.1

[56] References Cited

U.S. PATENT DOCUMENTS

| | | | |
|---|---|---|---|
| 1,852,883 | 4/1932 | Gustaveson | 36/3 B |
| 2,347,207 | 4/1944 | Margolin | 36/3 B |
| 3,533,171 | 10/1970 | Motoki | 36/3 B |
| 4,507,880 | 4/1985 | Ohashi | 36/3 B |
| 4,547,978 | 10/1985 | Radford | 36/3 B |
| 5,044,096 | 9/1991 | Polegato | 36/3 B |
| 5,285,546 | 2/1994 | Haimeri | 36/14 |
| 5,289,644 | 3/1994 | Driskill et al. | 36/14 |
| 5,416,986 | 5/1995 | Cole et al. | 36/29 |
| 5,433,021 | 7/1995 | Mahler | 36/12 |
| 5,505,011 | 4/1996 | Bleimhofer | 36/4 |
| 5,545,463 | 8/1996 | Schmidt et al. | 36/29 |
| 5,655,314 | 8/1997 | Petracci | 36/3 B |
| 5,678,326 | 10/1997 | Pavelescu | 36/14 |
| 5,768,802 | 6/1998 | Bramani | 36/59 C |

*Primary Examiner*—B. Dayoan
*Assistant Examiner*—Anthony Stashick
*Attorney, Agent, or Firm*—Oblon, Spivak, McClelland, Maier & Neustadt, P.C.

[57] ABSTRACT

A vapor-permeable shoe which includes an upper, a tread made of elastomer, shaped so as to form a plurality of domes whose convexity is directed toward the ground, each dome having at least one minute through slit which is normally closed due to the elasticity of the material and allows the outflow of a mixture of air and water vapor formed inside the shoe when the compression applied by the sole of the foot of a user generates an overpressure at the chambers formed internally by said domes, a vapor-permeable or perforated insole, and a waterproof and vapor-permeable protective membrane. The lower part of the upper, the tread and the membrane are perimetrically sealed in the regions where they join.

8 Claims, 2 Drawing Sheets

VAPOR PERMEABLE SHOE WITH IMPROVED TRANSPIRATION ACTION

BACKGROUND OF THE INVENTION

1. Field of the Invention

The present invention relates to a vapor-permeable shoe.

2. Discussion of the Background

It is known that a shoe, in order to be comfortable, must ensure correct exchange of heat and water vapor between the microclimate inside the shoe and the external microclimate. The exchanges of heat and vapor, however, must not compromise in any way the impermeability of the shoe to external humidity or water.

Currently commercially available shoes entrust the exchange of heat and water vapor substantially to the upper or to the sole. As regards the upper, shoes are commercially available which are perforated and/or provided with linings made of a vapor-permeable and waterproof material.

In some models, parts of the upper can be replaced with materials which are waterproof and at the same time vapor-permeable.

Another category of shoe instead entrusts transpiration to the sole, again by using layers of a waterproof and vapor-permeable material optionally associated with protective layers and fillers. These shoes, however, have not achieved an optimum exchange of heat and water vapor; accordingly, vapor-permeable shoes have been devised which are the subject of U.S. patent application 08/849,839, filed on Jun. 6, 1997, in which the shoe is constituted by the following elements: a vapor-permeable upper, associated with a vapor-permeable or perforated lining; a tread made of perforated elastomer; a mid-sole, which comprises at least one membrane made of vapor-permeable waterproof material associated with a lower protective layer made of a material which is resistant to hydrolysis, is water-repellent, vapor-permeable or perforated; and includes a vapor-permeable or perforated insole and a vapor-permeable or perforated filler layer arranged between said insole and said membrane.

The lower part of the upper, the tread and the mid-sole with the membrane are perimetrically sealed in the regions where they join.

Although this type of shoe solves many of the drawbacks observed in commercially available vapor-permeable shoes, it is not free from drawbacks, the main drawback being the fact that the vapor-permeable and waterproof membrane is not very strong from the mechanical point of view, is not protected in an optimum manner by the lower layer and can suffer damage due to interactions with blunt objects penetrating through the holes of the tread, which extend vertically with respect to the ground.

This type of shoe furthermore entails the drawback that the paths for the outflow of the air/water vapor mixture can clog at the sole, due to dirt wedging into the holes upon use.

SUMMARY OF THE INVENTION

The object of the present invention is to provide a vapor-permeable shoe which solves the drawbacks noted above of conventional shoes, particularly combining optimum heat and water vapor exchange, both through the upper and through the sole, with equally optimum protection of the components accommodated inside the sole.

Within the scope of this purpose, an object of the present invention is to provide a vapor-permeable shoe in which the sole is not subject to clogging of the transpiration paths.

Another object of the present invention is to provide a vapor-permeable shoe whose structure entails absolutely no restrictions in terms of styling and aesthetic research, allowing the greatest freedom of shape and production type.

Another object of the present invention is to provide a vapor-permeable shoe which is meant both for everyday use and for sports use.

Another object of the present invention is to provide a vapor-permeable shoe whose cost is competitive with respect to known vapor-permeable shoes.

A final object of the present invention is to provide a vapor-permeable shoe which can be manufactured with known technologies.

These objects and others which will become apparent hereinafter are achieved by a vapor-permeable shoe, comprising:

an upper;

a tread made of an elastomer, shaped so as to form a plurality of domes having a convexity directed toward the ground, each dome forming a chamber and having at least one minute slit which is normally closed due to the elasticity of the material and allows the outflow of the mixture of air and water vapor formed inside the shoe when compression applied by the sole of the foot of the user generates an overpressure at the chambers formed internally by said domes;

a vapor-permeable or perforated insole; and a waterproof and vapor-permeable membrane interposed between said insole and said tread, the lower part of said upper said tread and said membrane being perimetrically sealed in the regions where they join.

BRIEF DESCRIPTION OF THE DRAWINGS

Further characteristics and advantages of the present invention will become apparent from the following detailed description of two embodiments thereof, illustrated only by way of non-limitative example in the accompanying drawings, wherein.

DESCRIPTION OF THE PREFERRED EMBODIMENTS

Figure 1:
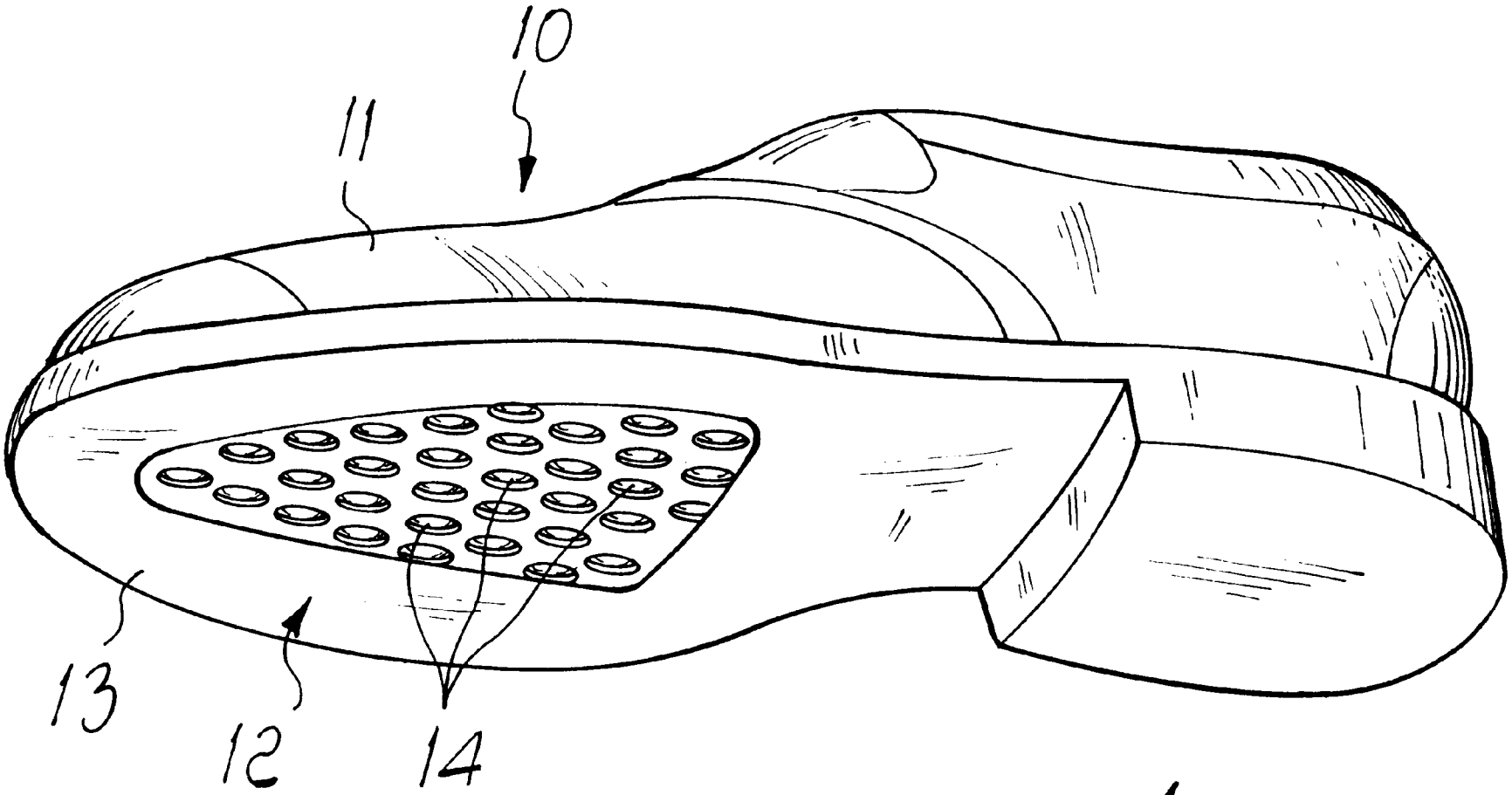
FIG. 1 is a perspective view of a first embodiment of a shoe according to the invention.
Figure 2:
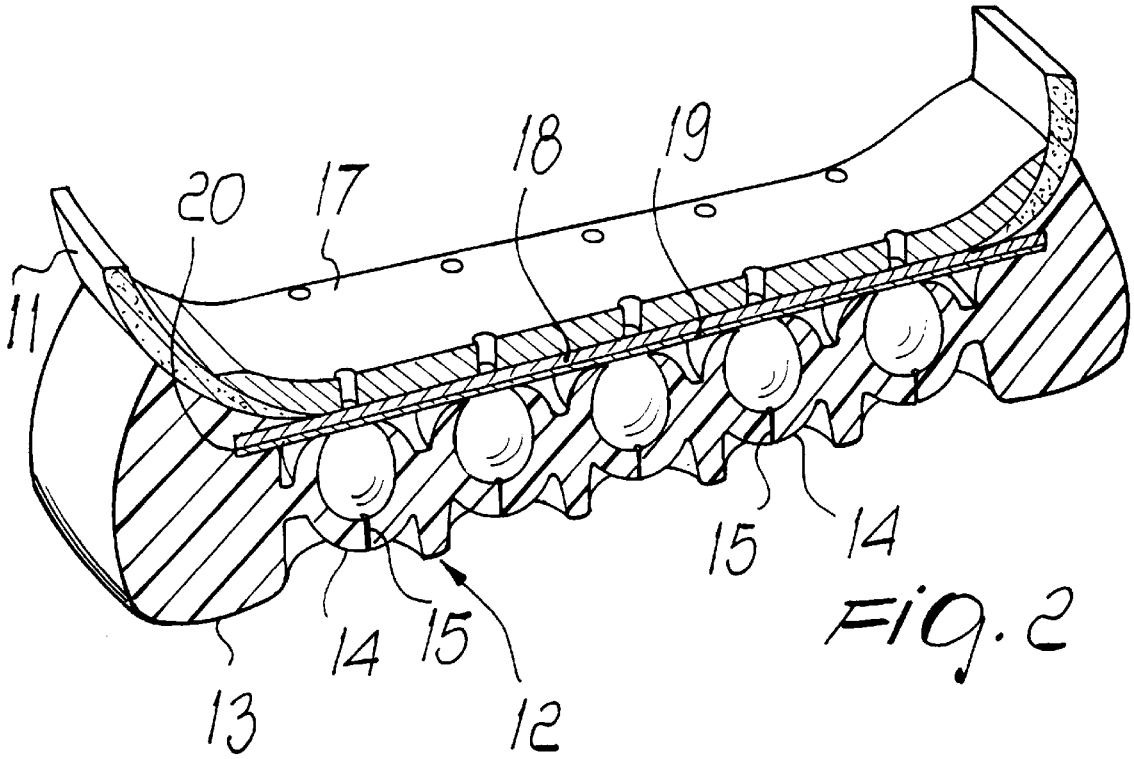
FIG. 2 is a sectional view of the shoe of FIG. 1.

With particular reference to FIGS. 1 and 2, a first embodiment of a vapor-permeable shoe according to the invention is generally designated by reference numeral 10.

The shoe 10 comprises a vapor-permeable upper 11 which is associated with a sole 12. The upper 11 can be associated with a vapor-permeable or perforated lining, which is not shown in the Figures. In particular, the sole 12 has a tread 13 made of an elastomer, for example rubber, which is shaped so as to form a plurality of domes 14 having a convexity directed toward the ground.

Each one of the domes 14 has, substantially at a top portion thereof, a minute through slit 15 which is normally closed by virtue of the elasticity of the material and allows the outflow of the air/water vapor mixture that has formed inside the shoe when the compression of the sole of the foot generates an overpressure at the chambers 16 formed internally by the domes 14.

The shoe 10 also comprises an insole 17, which in this case is perforated but can also be vapor-permeable, and a waterproof and vapor-permeable membrane 18 of the type known commercially as Gore-Tex.

In particular, in this case the membrane 18 is associated with a lower protective layer 19 made of a material which is resistant to hydrolysis, and is water-repellent, vapor-permeable or perforated. The membrane 18, together with the layer 19, has an edge 20 which is embedded in the tread 13 so as to seal the joint. A seal is also provided between the upper 11 and the tread 13.

As regards operation, the overpressure generated inside the shoe vents air through the insole 17, the membrane 18 with the layer 19, and the minute slits 15 of the tread 13, which act as one-way valves by virtue of the particular dome-like configuration of the regions in which they are located. Accordingly, air flow occurs in a single direction.

Impermeability is ensured by the combined effect of the membrane 18 with the minute slits 15, which are normally closed.

Figure 3:
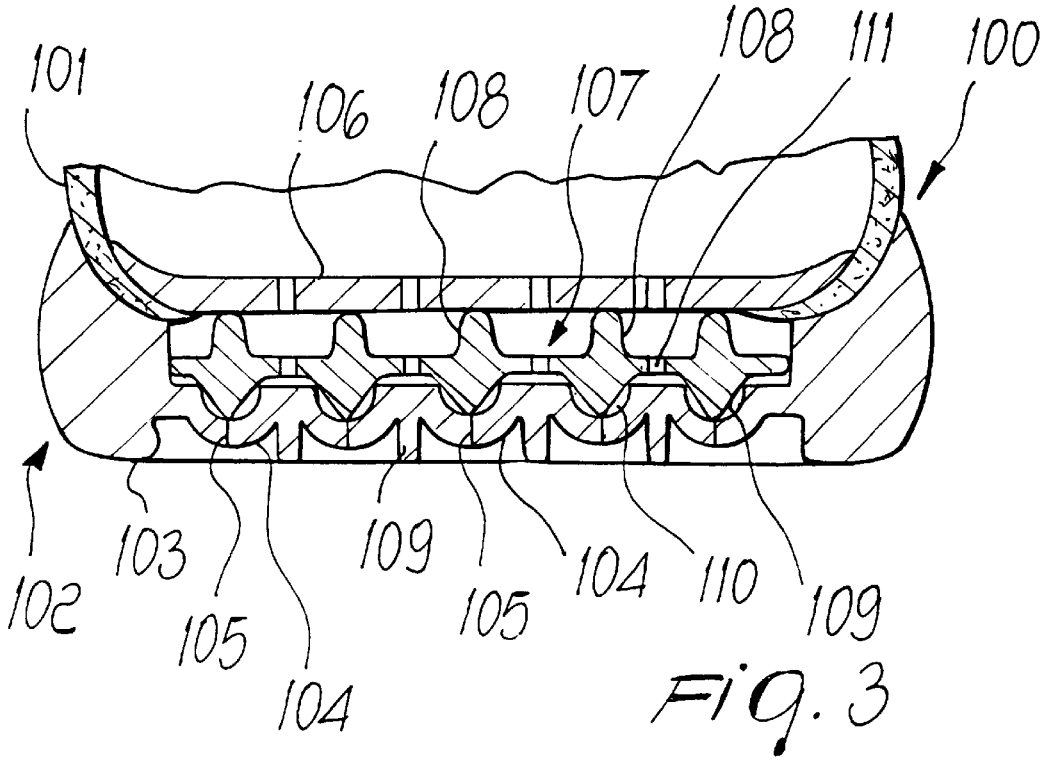
FIG. 3 is a sectional view of a second embodiment of a shoe according to the invention.

With particular reference to FIG. 3, a second embodiment of the vapor-permeable shoe according to the invention is generally designated by reference numeral 100.

In particular, the shoe 100 comprises an upper 101 (with an optional vapor-permeable or perforated lining, not shown), associated with a sole 102 which is in turn constituted by a tread 103 made of elastomer and shaped so as to form a plurality of domes 104 having a convexity directed toward the ground, each dome being provided with a minute through slit 105 which is normally closed by virtue of the elasticity of the material and allows the outflow of the mixture of air and water vapor, as described above.

The shoe 100 further comprises a vapor-permeable or perforated insole 106 and, between the insole and the tread 103, an intermediate element is provided which is generally designated by reference numeral 107 and is described hereinafter. In particular, the intermediate element 107 is shaped so as to form, at the surface that is directed toward the insole 106, a plurality of first raised portions 108 which are suitable to support the insole and keep it spaced.

The intermediate element 107 is also shaped at the surface that is directed toward the tread 103 so as to form a plurality of second conical raised portions 109, each of which is inserted in a corresponding chamber 110 formed by the corresponding dome 104.

In particular, each one of the second raised portions 109 is suitable to close the opening of the corresponding chamber 10 when it is pushed and compressed by the sole of the foot, not shown, which rests thereon.

Through holes 111 are provided in the intermediate element 107 in order to allow the flow of air between the upper region and the lower region. The upper 101, the intermediate element 107 and the tread 103 are sealed in the regions where they join.

The intermediate element 107 provides outward mechanical pumping, through the minute slits 105, of the air that is in the regions between the second conical raised portions 109 and the domes 104, when the conical raised portions 109 perform alternating movements due to walking, particularly with downward movements after they have closed the corresponding chambers 110 and compressed the air contained therein. The flow of air is unidirectional and a good impermeability effect is ensured by the fact that the minute slits 105 are normally closed.

In a different embodiment, not shown in the Figures, it is possible to arrange between the intermediate element 107 and the insole 106 a membrane 18, optionally associated with a protective layer such as 19.

In practice it has been observed that the present invention has solved the intended aim and objects. In particular, it should be noted that the shoe according to the invention combines the need to provide optimum foot transpiration with the possibility to adequately protect the components inside the sole.

It should also be noted that the first embodiment combines the impermeability and vapor-permeability advantages of the membrane-fitted shoes cited in the introduction with the advantages of shoes in which the transfer of the air contained therein is performed mechanically with valves actuated by the compression of the foot during walking.

It should also be noted that the shoe according to the invention, in addition to being particularly tough, is substantially impermeable to external water vapor and water.

It is further noted that the structure of the shoe according to the invention does not compromise in any way research in terms of quality styling and aesthetic solutions.

It should also be noted that the constructive simplicity of the shoe according to the invention allows the achievement of production costs which are competitive with respect to similar commercially available shoes.

The present invention is capable of numerous modifications and variations, all of which are within the scope of the inventive concept.

The constructive details discussed can be replaced with other technically equivalent elements. The materials and the dimensions may be any according to requirements. The disclosures in Italian Patent Application No. PD97A000230 from which this application claims priority are incorporated herein by reference.

What is claimed is:

1. A vapor-permeable shoe, comprising:

an upper;

a tread made of an elastomer, said tread being fastened to said upper and being shaped so as to form a plurality of domes having a convexity directed toward the ground, each dome forming a chamber and having at least one minute through slit which is normally closed due to the elasticity of the material and allows outflow of a mixture of air and water vapor formed inside the shoe when compression applied by the sole of the foot of a user generates an overpressure at the chambers formed internally by said dome;

a vapor-permeable or perforated insole; and a waterproof and vapor-permeable membrane interposed between said insole and said tread, the lower part of said upper, said tread and said membrane being perimetrically sealed in regions where said tread and said membrane are joined.

2. The vapor-permeable shoe according to claim 1, wherein said upper is vapor-permeable and is associated with a vapor-permeable or perforated lining.

3. The vapor-permeable shoe according to claim 1, which comprises a protective layer made of a material which is resistant to hydrolysis, is water-repellent, vapor-permeable or perforated and is directed toward the tread and which contacts said membrane.

4. The vapor-permeable shoe, comprising:

an upper;

a tread made of an elastomer, said tread being fastened to said upper and being shaped so as to form a plurality of domes having a convexity directed toward the ground, each dome forming a chamber and having at least one minute through slit which is normally closed due to the elasticity of the material and allows the outflow of a mixture of air and water vapor formed inside the shoe when compression applied by the sole of the foot of the user generates an overpressure at the chambers formed internally by said domes;

a vapor-permeable or perforated insole;

a perforated intermediate element, said element being shaped so as to form, at a surface that is directed toward the tread, a plurality of conical raised portions, each of which is inserted in a corresponding chamber formed by a corresponding dome and closes said corresponding chamber when pushed and compressed by the sole of a foot of a wearer that rests thereon.

5. The vapor-permeable shoe according to claim 4, wherein said upper is vapor-permeable and is associated with a vapor-permeable or perforated lining.

6. The shoe according to claim 4, wherein said intermediate element has, at a surface directed toward the insole, a plurality of raised portions which are suitable to support said insole and keep it spaced from said domes.

7. The shoe according to claim 4, wherein a vapor-permeable and waterproof membrane is arranged between said intermediate element and said insole.

8. The shoe according to claim 7, which comprises a lower protective layer made of a material which is resistant to hydrolysis, is water-repellent, vapor-permeable or perforated and which is directed toward the tread and contacts said membrane.

* * * * *